United States Patent [19]

Fischer et al.

[11] 4,433,265

[45] Feb. 21, 1984

[54] COOLED DISCHARGE LAMP HAVING A FLUID COOLED DIAPHRAGM STRUCTURE

[75] Inventors: Helmut Fischer, Hanau; Jürgen Schäfer, Hasselroth; Günter Thomas, Hanau, all of Fed. Rep. of Germany

[73] Assignee: Original Hanau Heraeus GmbH, Hanau am Main, Fed. Rep. of Germany

[21] Appl. No.: 156,104

[22] Filed: Jun. 3, 1980

[30] Foreign Application Priority Data

Jun. 12, 1979 [DE] Fed. Rep. of Germany ..... 2923724

[51] Int. Cl.[3] ..... H01J 61/34; H01J 61/52; H01J 61/64

[52] U.S. Cl. ..... 313/22; 313/32; 313/609

[58] Field of Search ..... 313/32, 33, 210, 22

[56] References Cited

U.S. PATENT DOCUMENTS 3,401,292 9/1968 Cirri ..... 313/32
3,541,371 11/1970 Legros et al. ..... 313/32
3,851,213 11/1974 Van Dam et al. ..... 313/193 X

FOREIGN PATENT DOCUMENTS 1042115 10/1958 Fed. Rep. of Germany .
1152482 8/1963 Fed. Rep. of Germany ..... 313/22
1208420 1/1966 Fed. Rep. of Germany .
1219586 6/1966 Fed. Rep. of Germany .
1273690 7/1968 Fed. Rep. of Germany .

*Primary Examiner*—Palmer C. Demeo
*Attorney, Agent, or Firm*—Frishauf, Holtz, Goodman & Woodward

[57] ABSTRACT

To cool the diaphragm of a spectral discharge lamp having an anode and a cathode between which a discharge is established, which discharge is controlled by the diaphragm, a fluid supply and removal duct is connected to a cooling circuit in or on the diaphragm structure to supply, for example, water to cool the diaphragm. The tube or bulb of the lamp may be in form of a jacketed enclosure through which cooling water is conducted, preferably in the same supply and removal circuit as that for the diaphragm structure.

16 Claims, 4 Drawing Figures

COOLED DISCHARGE LAMP HAVING A FLUID COOLED DIAPHRAGM STRUCTURE

The present invention relates to a gas discharge lamp, and more particularly to a deuterium discharge lamp, in which a discharge is maintained between an anode and a cathode, and the output of the discharge is directed through a diaphragm and through a window in the lamp housing.

BACKGROUND AND PRIOR ART

Discharge lamps which provide for discharges in which the discharge beam is controlled by providing a focusing or beam forming element, such as a diaphragm between the anode and cathode, are known. The diaphragm, with an opening therethrough, being subject to the discharge itself will become hot. It was previously been proposed to enclose the electrode system of discharge lamps in a metallic housing, the outer surface of which is engaged by resilient clips, such as spring clips, bails, or spring sheets. Since the housing is of metal, the resilient elements engaging the metal housing will provide for some heat conduction from the housing. Such a construction is described in German Patent DE-PS No. 11 52 482.

THE INVENTION

It is an object to improve the radiation density from discharge lamps by providing for improved heat dissipation from the diaphragm thereof.

Briefly, the lamp has cooling ducts connected through and into the lamp housing, the cooling ducts supplying and removing a cooling fluid which is connected to cool the diaphragm structure.

It has been found that cooling the diaphragm structure as it is supported in the housing permits substantial increase in the power available from the lamp, since the heat dissipation from the diaphragm itself is substantially improved. The radiation density is approximately proportional to electrical power input. Thus, without increasing the opening in the diaphragm, the power output from the lamp can be substantially increased.

DRAWINGS

The discharge lamps to which the present invention is applied are interiorly small; the dimensions of the electrode system thus cannot be increased to accomodate cooling arrangements requiring substantial space. Radiation can be emitted, for all practical purposes, only from one end face of the tube or lamp, and the opposite end of the lamp—in elongated bulb shape—is then used to connect current supply conductors to the lamp.

Figure 3:
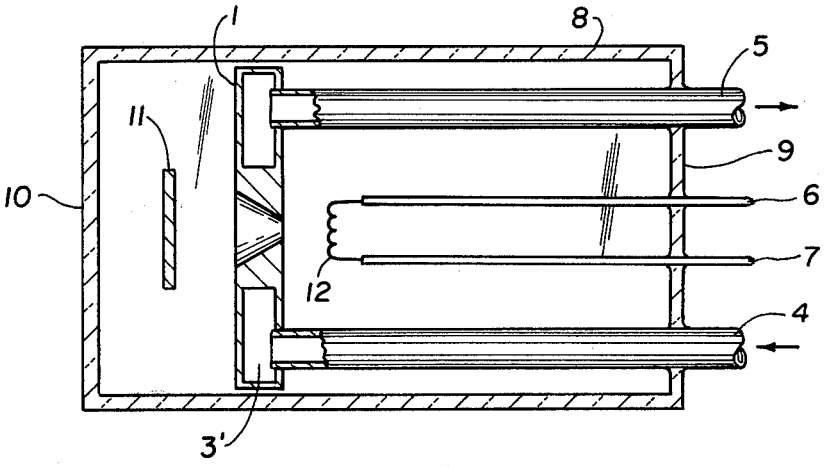
FIG. 3 is a schematic longitudinal view through a lamp cooled in accordance with the present invention.

The general outline of the lamp is best seen in FIG. 3 in which electrical conductors 6, 7, melted through a quartz glass housing 8, are provided to supply current to a cathode 12. An anode 11 is positioned within the tube—in accordance with standard construction—and radiation is emitted through the end remote from the electrical connection end of the tube, formed as a window 10. The window 10 can be integral with the housing 8. The cathode 12, preferably, is a tungsten spiral filament; anode 11 is a ring or a disk made of tungsten or molybdenum. A diaphragm structure 1 is located between the anode and the cathode to focus or shape the beam between anode and cathode.

Figure 1:
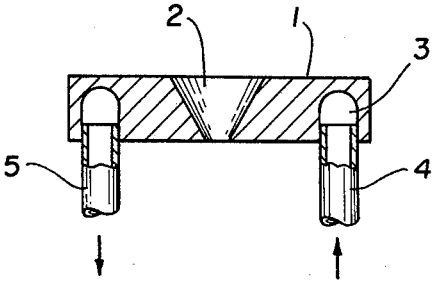
FIG. 1 is a highly schematic cross-sectional view through the diaphragm showing the cooling arrangement in accordance with the present invention.

FIG. 1 illustrates the diaphragm structure, which forms the primary subject matter of the present invention. The diaphragm structure 1, usually in form of a circular disk, has a central opening which is funnel-shaped or conically diverging from a narrow opening to a wider opening, in the direction of the passage of the electron beam from cathode to anode. The or opening bore 2 is preferably centrally located within the structure 1. In accordance with the invention, the diaphragm structure 1 is cooled. For cooling duct 3 is formed in the structure 1, to which a cooling fluid supply line 4 is connected. Diametrically opposite the connection of duct 4 is a fluid removal duct 5. The entire structure 1, looked at from the top, is a circular disk with a central opening to form a ring. The material is highly heat-resistant, for example made of molybdenum. The outer diameter of the body 1 is between 5 to 8 cm. The smallest diameter of the opening 2 can be about 1 mm, diverging, for example, as shown.

Lines 4, 5, which may also form the support for the diaphragm structure 1, preferably are made of corrosion resistant metal or alloy, for example stainless steel, nickel, or nickel alloys.

Figure 2:
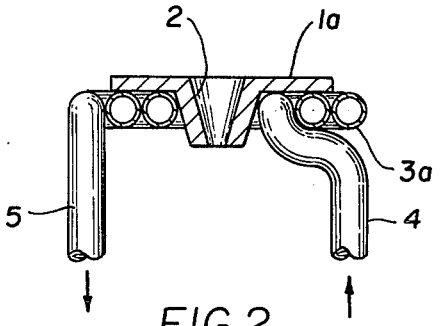
FIG. 2 illustrates another arrangement for providing the ducts to supply and remove cooling fluid.

The diaphragm 1*a* of FIG. 2 has a ring-shaped body with the central opening 2, similar to that shown in FIG. 1. The cooling ducts 3*a*, in cross section, are circular and are positioned in form of a spiral—when looked at in plan view from the top—and connected to respective supply and removal lines 4, 5 as in the embodiment of FIG. 1.

The essential feature in both of the embodiments is the direct heat transfer by conducting cooling fluid to the diaphragm structure. A suitable cooling fluid is water.

FIG. 3 illustrates the sealed introduction of the current supply conductors as well as of the support and cooling fluid supply lines 4, 5. FIG. 3 further illustrates a modified form of the cooling duct itself; a ring duct 3', having a cross-sectional area which is large with respect to that of the circular duct 3 of FIG. 1 is provided.

The window 10, like the housing of the bulb of the tube or lamp, is also made of radiation-transmissive quartz glass. The discharge occurs between the cathode 12 and the anode 11.

Figure 4:
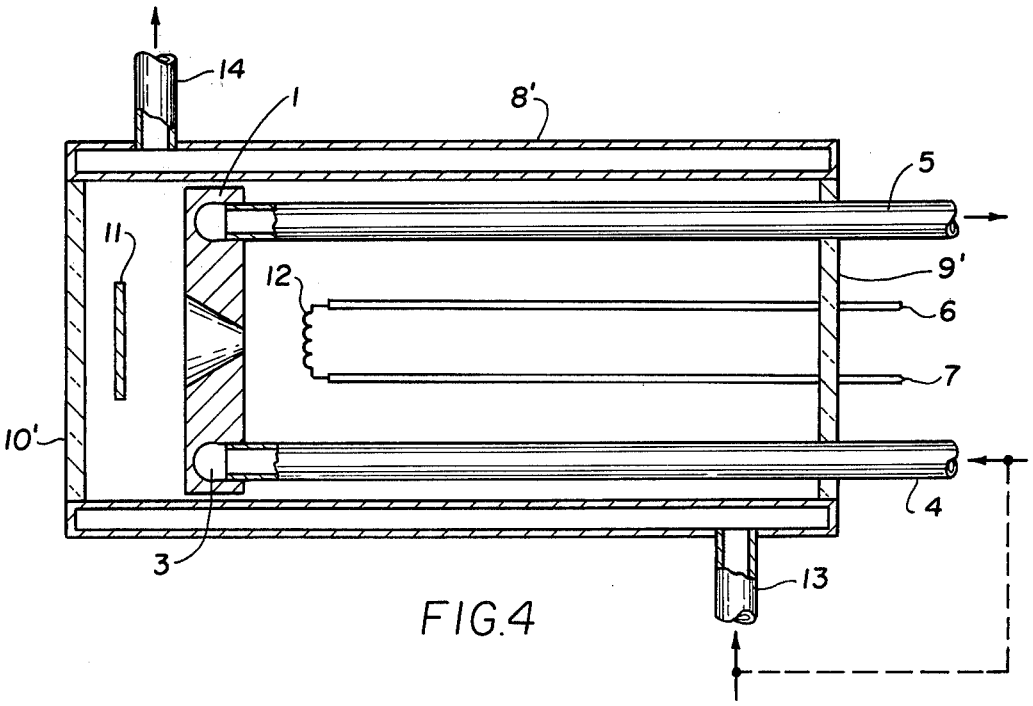
FIG. 4 is a longitudinal sectional, highly schematic view illustrating a housing with a cooling jacket.

The embodiment of FIG. 4 illustrates a lamp with a part-metal lamp bulb. The lamp housing of FIG. 4 has a jacketed, essentially cylindrical metal structure 8', with supply and removal connection lines 13, 14 attached thereto to supply and remove cooling fluid, for example water, to the space formed by the jacket 8'. Preferably, the cooling fluid circuit which is used for the diaphragm 1 is the same as that which is used for the outer jacket, as shown, schematically, by the broken-line connection between the arrows leading to the cooling fluid connecting lines 4 and 13. The bottom face 9' of the tube or lamp has the connecting ducts 4, 5, as well as current conductors 6, 7 pass therethrough—the conductors, of course, being insulated from each other. The bottom 9' is secured to the jacket 8'. Both the electrical as well as the cooling fluid connections are led therethrough in gas-tight manner. The window 10′ closes off the other end of the tube and is set into the jacket 8′, as seen in FIG. 4. The window 10′ must have the characteristic that it passes radiation in the wave length primarily emitted by the lamp substantially without, or with only little, attenuation. In a spectral lamp having a deuterium or hydrogen fill, the wave length is less than 350 nm. Deuterium lamps or hydrogen lamps are discharge lamps in which the fill comprises essentially the respective gas or may consist of the respective gas. Additives of further gases, preferably noble gases, may be used.

Various changes and modifications may be made, and features described in connection with any one of the embodiments may be used with any of the others, within the scope of the inventive concept.

The basic lamp structure is known, see, for example, Deuterium Lamp D200F, "Original-Hanau", and forming a standard article of commerce available, for example, from the assignee of the present invention.

We claim:

1. Cooled discharge lamp, particularly for generation of specific spectral output comprising a closed, gas-tight lamp housing (8, 9, 10) formed with a window (10);

a cathode (12) and an anode (11) positioned in alignment with said window in the housing;

electrical current supply conductors (6, 7) extending through the lamp housing and connected to the cathode, a metal diaphragm structure (1) formed with a diaphragm opening (2) therethrough and positioned between said cathode and anode, and metallic cooling fluid supply and removal duct means (4, 5) sealed into and extending through the walls of the lamp housing into the interior thereof, and wherein the diaphragm structure is disk-like and formed with interior duct means (3, 3′,)

said fluid supply duct means being connected to said interior duct means.

2. Discharge lamp according to claim 1, wherein the housing (8, 9, 10) comprises quartz glass.

3. Discharge lamp according to claim 1, wherein the housing (8, 9, 10) comprises metal in which said window (10) is set.

4. Discharge lamp according to claim 3, wherein the housing is a jacketed, double-wall housing (8′);

housing cooling fluid supply and removal duct means (14, 15) are connected to the jacketed housing, and the window (10) is fitted gas-tight within said housing.

5. Discharge lamp according to claim 4, wherein the housing cooling supply and removal duct means and the cooling fluid supply and removal duct means for the diaphragm structure are connected in a single cooling fluid circuit.

6. Discharge lamp according to claim 1, wherein the housing comprises an essentially cylindrical metal body, a bottom plate (9′) being secured to said metal body through which said electrical current supply conductors and said fluid supply and removal duct means extend, sealed thereto in gas-tight relation.

7. Discharge lamp according to claim 6, wherein the window (10) is sealed into the cylindrical housing, in gas-tight relation.

8. Discharge lamp according to claim 1 wherein the interior duct means comprises an essentially circular, closed duct within the diaphragm structure, connected to said supply and removable duct means.

9. Discharge lamp according to claim 1 further including a fill of deuterium in the housing.

10. Cooled discharge lamp, particularly for generation of specific spectral output comprising a closed, gas-tight lamp housing (8, 9, 10) formed with a window (10);

a cathode (12) and an anode (11) positioned in alignment with said window in the housing;

electrical current supply conductors (6, 7) extending through the lamp housing and connected to the cathode, a metal diaphragm structure (1) formed with a diaphragm opening (2) therethrough and positioned between said cathode and anode, and metallic cooling fluid supply and removal duct means (4, 5) sealed into and extending through the walls of the lamp housing into the interior thereof;

wherein the diaphragm structure is disk-like;

and an essentially spirally arranged duct is placed against and in direct heat transfer relation to the disk-like diaphragm structure by structural and thermal connection therewith, said essentially spirally arranged duct being connected to said fluid supply and removal duct means.

11. Discharge lamp according to claim 10 wherein the housing (8, 9, 10) comprises quartz glass.

12. Discharge lamp according to claim 10 wherein the housing (8, 9, 10) comprises metal in which said window (10) is set.

13. Discharge lamp accoridng to claim 12, wherein the housing is a jacketed, double-wall housing (8′);

housing cooling fluid supply and removal duct means (14, 15) are connected to the jacketed housing and the window (10) is fitted gas-tight within said housing.

14. Discharge lamp according to claim 13, wherein the housing cooling supply and removal duct means and the cooling fluid supply and removal duct means for the diaphragm structure are connected in a single cooling fluid circuit.

15. Discharge lamp according to claim 1, wherein the housing comprises an essentially cylindrical metal body, a bottom plate (9′) being secured to said metal body through which said electrical current supply conductors and said fluid supply and removal duct means extend, sealed thereto in gas-tight relation.

16. Discharge lamp according to claim 1 further including a fill of deuterium in the housing.

* * * * *

UNITED STATES PATENT AND TRADEMARK OFFICE

CERTIFICATE OF CORRECTION

PATENT NO. : 4,433,265

DATED : February 21, 1984

INVENTOR(S) : Helmut FISCHER et al

It is certified that error appears in the above-identified patent and that said Letters Patent is hereby corrected as shown below:

Claim 15, Col. 4, line 50, "...to claim 1..." should be -- ...to claim 10... --

Col. 2, lines 15-16, "The or opening bore 2" should be
-- The bore or opening 2 --

Col. 2, line 18, "For cooling duct 3" should be -- For cooling a ring-shaped duct 3 --.

Signed and Sealed this

*Twenty-sixth* Day of *February 1985*

[SEAL]

*Attest:*

DONALD J. QUIGG

*Attesting Officer* *Acting Commissioner of Patents and Trademarks*